US005228407A

United States Patent [19]

Cummer et al.

[11] Patent Number: 5,228,407

[45] Date of Patent: Jul. 20, 1993

[54] RIGID INFLATABLE BOAT

[75] Inventors: John L. Cummer, Victoria, Canada; Jack W. Sarin; Paul Fredrickson, both of Bainbridge Island, Wash.; James P. Kindsvater, Everett, Wash.; Stephen L. Davis, Port Hadlock, Wash.

[73] Assignee: Barry Douglas Enterprises Ltd., Olympia, Wash.

[21] Appl. No.: 648,060

[22] Filed: Feb. 1, 1991

[51] Int. Cl.[5] ..... B63B 7/08

[52] U.S. Cl. ..... 114/345; 441/40

[58] Field of Search ..... 441/40–42, 441/65, 66; 114/85, 140, 142, 267, 343, 345, 355, 364, 121, 125

[56] References Cited

U.S. PATENT DOCUMENTS

| | | | |
|---|---|---|---|
| 2,980,049 | 4/1961 | Ward | 114/140 |
| 3,503,358 | 3/1970 | Moesly | 114/125 |
| 4,779,355 | 10/1988 | Hong | 114/345 |
| 4,934,381 | 6/1990 | Harding | 114/345 |
| 4,976,213 | 12/1990 | Smith | 114/345 |
| 4,993,342 | 2/1991 | Eymard | 114/345 |

FOREIGN PATENT DOCUMENTS

| | | | |
|---|---|---|---|
| 2-63991 | 3/1990 | Japan | 114/345 |

*Primary Examiner*—Joseph F. Peters, Jr.
*Assistant Examiner*—C. T. Bartz
*Attorney, Agent, or Firm*—David J. French

[57] ABSTRACT

A ridged inflatable boat is provided with cavities formed on the out-board side of the hull, between the hull and the surrounding pneumatic tube, whereby fastening hardware intended to either retain the pneumatic tube or above deck hardware, may pass through the hull, deck or gunwhale without puncturing the pneumatic tube.

5 Claims, 6 Drawing Sheets

7
6
1
14
4a
4
3
2
5

RIGID INFLATABLE BOAT

FIELD OF THE INVENTION

This invention relates to a boat of the type that incorporates a pneumatically inflated tube in conjunction with a shaped displacement hull—a "rigid inflatable". More particularly, it relates to a new gunwale configuration and other features for such a boat.

BACKGROUND TO THE INVENTION

True inflatable boats have the advantages of lightness and collapsibility. However, they are deficient in sea-handling qualities. Rigid inflatables combine the features of soft inflatable gunwales, which provide floatation, with a solid "V" shaped hull that really improves the seaworthiness of the combined vessel.

Lightweight runabout motorboats are in demand as auxiliary craft to larger vessels. Both inflatables, and rigid inflatables are popular for this class of use. Major advantages of the pneumatic floatation tubes that surround both classes of boats are:

1. the pneumatic tubes act as "bumpers" when approaching docks and when the boats are hung on davits;
2. the high level of floatation provided by having the pneumatic cylinders at the outermost sides of the gunwales allows passengers to sit out-board or exit by stepping off the gunwale. They also permit the easy retrieval of persons and objects from the water;
3. the boat remains more upright in high seas, and during high speed turns; and
4. this last feature is enhanced in boats of known design that incorporate a self-bailing water ballast tunnel that self-evacuates when the boat rises to planing speed.

In the latter case a deep hull is provided which, when the boat is near stationary, does not tend to float the pneumatic tubes out of, or up from, the water. The concept of the water ballast tunnel is shown in Norwegian patent 103822 issued in 1964 to Jan Linge.

Various means have been employed for fastening pneumatic floatation tubes to a boat. In U.S. Pat. No. 4,416,639 to Gillmer a standard sailing dingy is provided with a floatation collar or "pneumatic sponson". It is suggested that this tubing may be attached to the gunwale by glue, or embracing bands.

U.S. Pat. No. 4,750,448 to Hennebutte shows pneumatic side-stabilizing tubes that are inset into a partially embracing longitudinal recess running the length of the gunwale. Straps extending around the outer circumference of the tubes provide further security to ensure the retention of the inflated tubes within their longitudinal cowling. It is to be noted in the Hennebutte design that the rigid portion of the gunwale, constituting outboard decking extends overboard by about 45 degrees beyond the vertical. This design thereby limits the exposed bump-accommodating periphery of the tubing to a segment whose depth is about one-eighth of the tube's diameter. As well, when a person is pulled out of the water over this design of gunwale, they are mostly exposed to the more grating surface of the cowling, rather than the tube.

This same feature of an over-wrapping cowling that extends beyond the upper median line of the outer floatation tubes is similarly shown in U.S. pat. No. 3,261,038 to Klepper. Such an over-wrapping feature is presumably desirable in order to transfer lifting force generated by the floatation tubes to the ridges side walls and hull to which they are attached. Again Klepper employs external straps to retain the pneumatic tube in place within the longitudinal recess formed between the gunwale and boat hull.

As an alternate retention means a longitudinally aligned pin, which is adhesively bonded to the outer tube, fits within a mating recess or groove running along the under surface of the over hanging cowling. Such pin is not, however, engaged with the cowling but is merely pressed into it by pneumatic pressure.

While these and other examples of the prior art have endeavoured to combine pneumatic tubes with rigid hulls in varying ways, they have not done so in the manner of the invention hereafter described.

The invention in its general form will first be described, and then its implementation in terms of specific embodiments will be detailed with reference to the drawings following hereafter. These embodiments are intended to demonstrate the principle of the invention, and the manner of its implementation. The invention will then be further described, and defined, in each of the individual claims which conclude this Specification.

SUMMARY OF THE INVENTION

In accordance with the invention in a rigid inflatable boat of the type having:

1. a rigid hull with a side portion terminating along its upper edge in a rigid gunwale, the gunwale having a load supporting deck portion along its outer periphery;
2. a pneumatic tube-receiving longitudinal recess formed in said hull along the out-board side of the gunwale, beneath the deck; and
3. a pneumatic tube fitted within the recess, the pneumatic tube being provided with coupling means;

such boat is further provided with an under-deck cavity that extends between the inboard side of the pneumatic tube and the outer surface of the hull, such cavity being of sufficient dimensions to receive and accommodate fastening hardware. Two applications for a cavity so formed are contemplated.

According to one alternate form of the invention the pneumatic tube is anchored within the above referenced recess by fastening hardware which is attached to the boat hull and passes through the aforesaid cavity to engage with the coupling means on the pneumatic tube. Preferably, a series of such cavities, each with fastening hardware, is provided to allow engagement of such fastening hardware with a complementary series of coupling means attached to the pneumatic tube.

According to another alternate form of the invention, a cavity may be formed between the tube and the hull that extends longitudinally and lies directly beneath the deck to thereby provide an under-deck open space by which accessories may be attached to the deck by through-the-deck fastenings. This is particularly advantageous as a boat may thereby be suspended from a davit by gunwale-mounted lifting rings. Alternately, other deck gear such as down riggers may be similarly fastened to the gunwales by bolting through the deck portion.

By a further feature of the invention the foregoing recess does not embrace substantially more than 50 percent of the circumference of the pneumatic tube. In a preferred version, the recess does not embrace more than 40% of the circumference of the pneumatic tube, and the deck portion of the gunwale does not over-lie more than 50% of the pneumatic tube.

By a further feature of the invention a boat as described above has a "V" shaped hull with a self-evacuating water ballast tunnel located along and just above the keel. The displacement of the hull is arranged to be such that the pneumatic tubes ride clear of the water with minimal free-board, preferably of about three inches, with the water ballast tunnel flooded and the boat loaded to its standard capacity. This configuration eliminates drag from the tubes while providing lateral stability since, when the boat is only slightly tipped, the tubes contact the water and provide buoyancy.

By a further feature of the invention, the water ballast tunnel is vented at the bow end through a vent-opening, directed downwardly, towards the water from an elevated location on the side of the hull.

The foregoing summarizes the principal features of the invention. The invention may be further understood by the description of the preferred embodiments, in conjunction with the drawings, which now follow.

DESCRIPTION OF THE PREFERRED EMBODIMENTS

Figure 1:
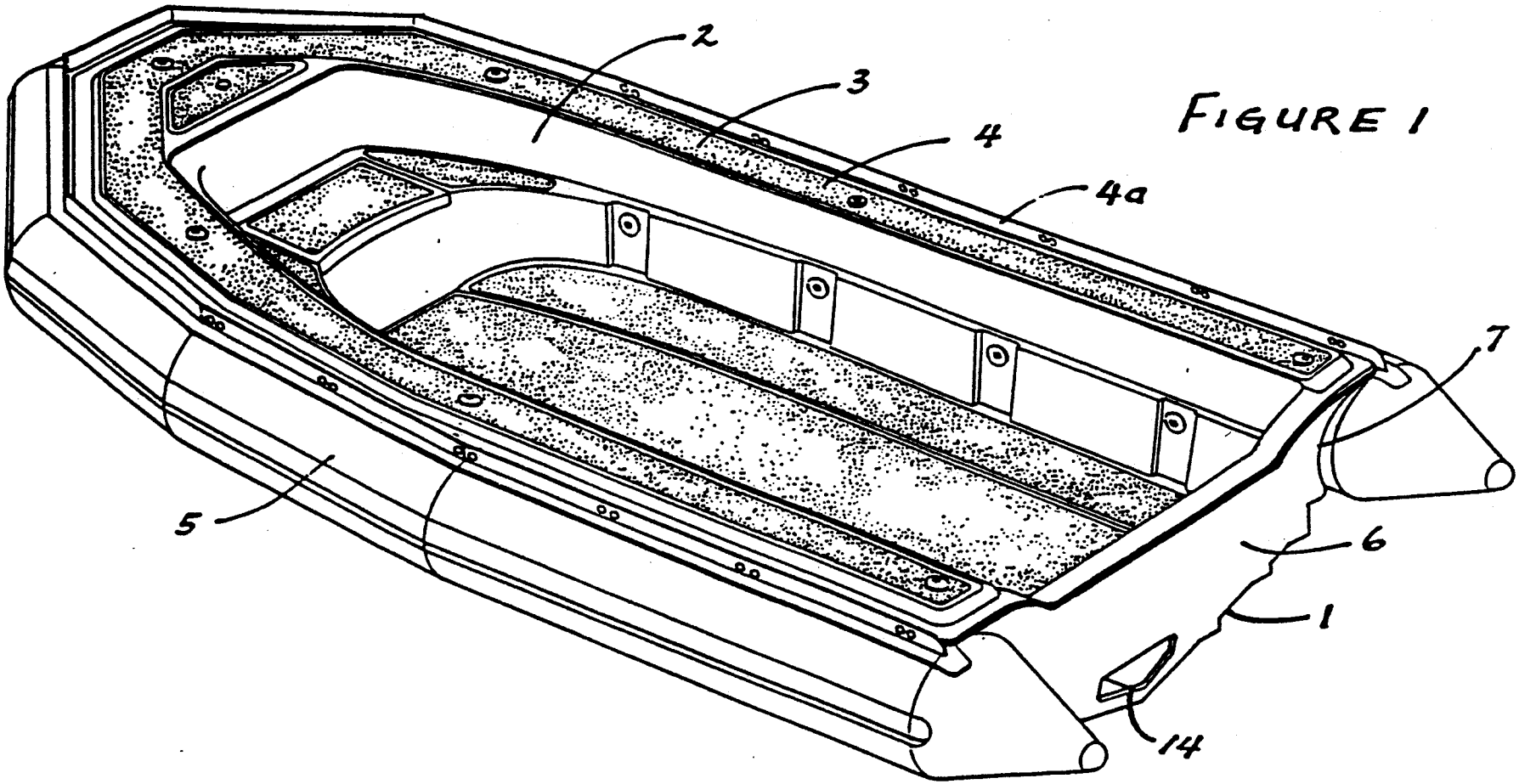
FIG. 1 is a perspective view of a rigid inflatable boat incorporating the invention.

In FIG. 1, a boat in accordance with the invention has a rigid hull 1 with the side portion 2 terminating in a gunwale 3. The gunwale has a deck portion 4 which is sufficiently rigid to support loads. Optionally, the deck portion 4 may carry a flange or rail 4*a*.

Pneumatic tube portions 5 optionally lie around the entire outer perimeter of the hull 1, except at the transom 6. The tube portions 5 lie within a recess 7 that underlies the deck portion 4.

Figure 2:
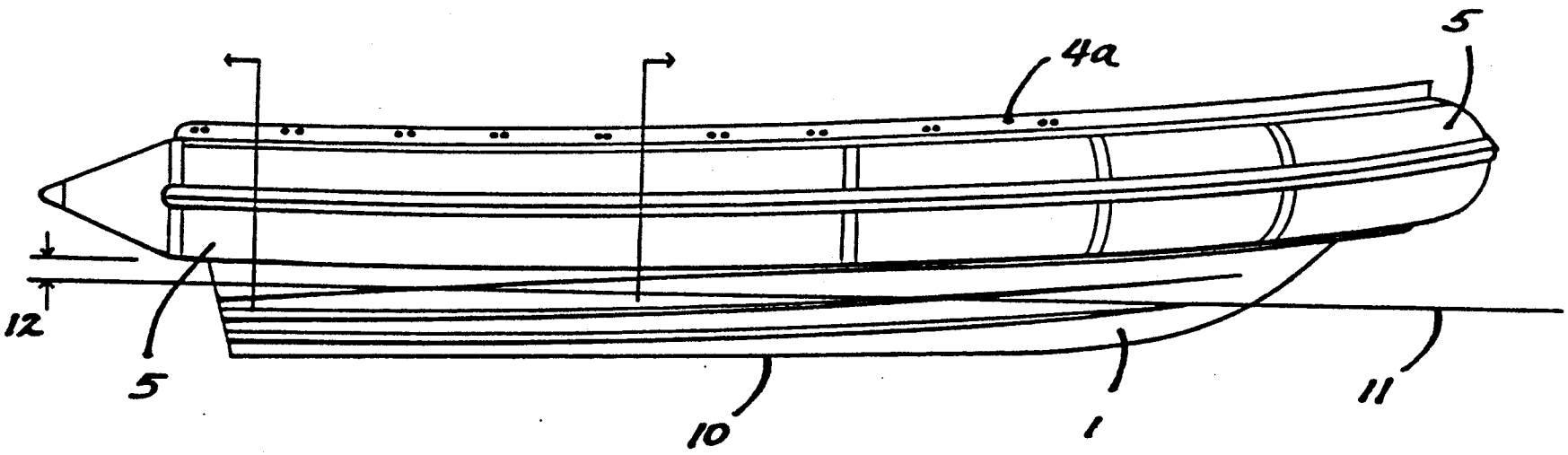
FIG. 2 is a side view of the boat of FIG. 1 showing "V" shaped hull (which contains the water ballast tunnel) in profile, with pneumatic tubes in place.

In FIG. 2 the keel 10 can be seen to be extended substantially below the water line 11. The free-board 12 between the tube portions 5 and the waterline 11 is minimal for the greater portion of the boat's length. For a 24 foot boat unloaded, this free-board 12 is preferably on the order of 3 - 3 ½ inches, dropping to 2 ½ - 3 inches when loaded.

Figure 3:
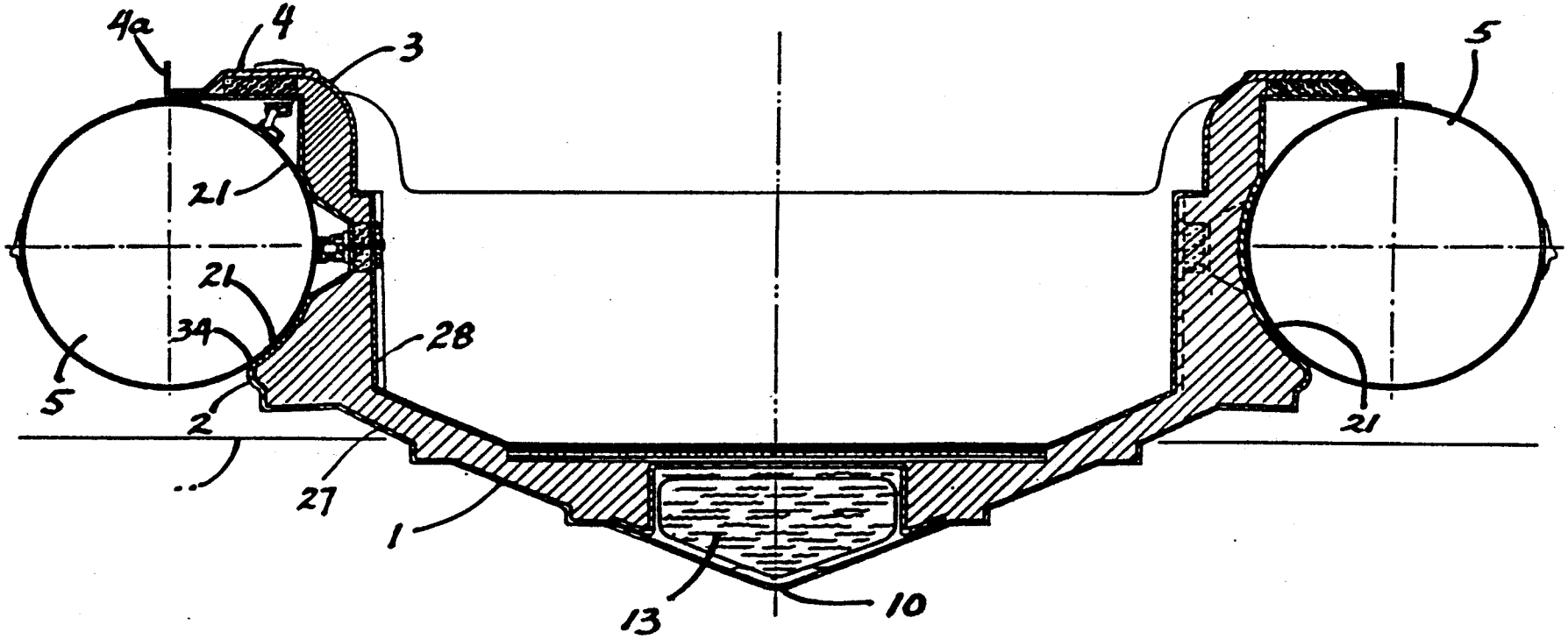
FIG. 3 is a full transverse cross-section of the boat of FIG. 2.

In FIG. 3 the water ballast tunnel 13 can be seen just above the keel 10. On a 14 foot boat, a water ballast load of 250pounds has been found satisfactory. The rear-exit 14 to the tunnel 13 can be seen in the transom 6, as shown in FIG. 1. An air vent passage 15 communicates with the water ballast tunnel 13 at its forward end.

Figure 4:
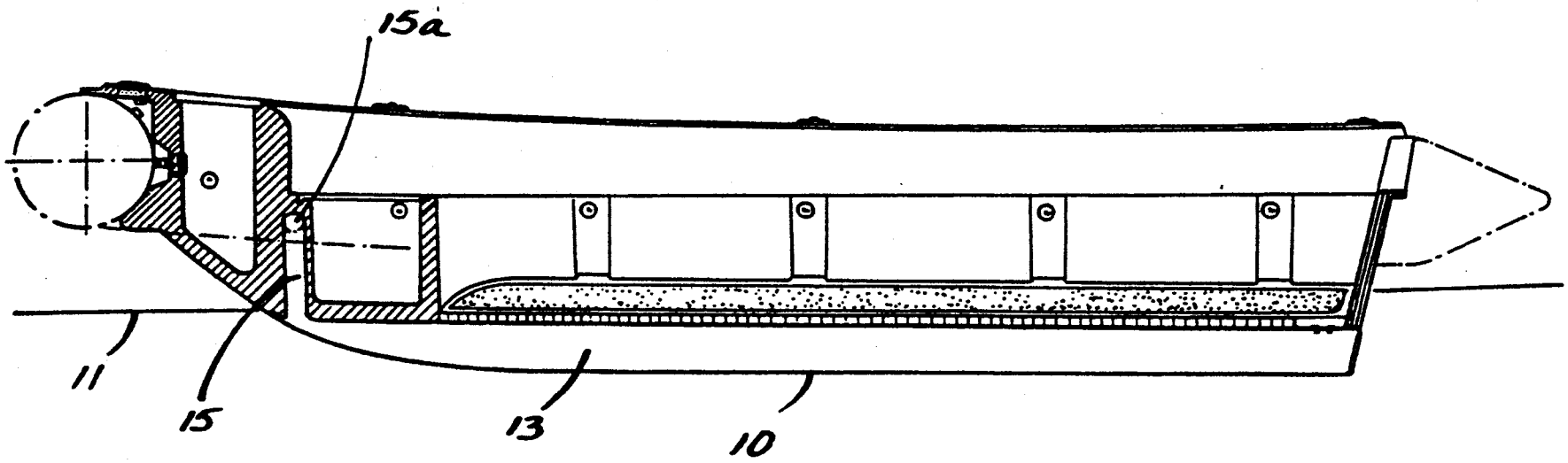
FIG. 4 is a longitudinal cross-section of the boat.

The air vent passage 15 is best seen in FIG. 4 where it is shown as passing from the water ballast tunnel to the atmosphere. By orienting the opening end 15*a* of this vent downwardly, towards the water surface, water which surges forward within the water ballast tunnel 13 is directed downwardly when the boat decelerates. Without such a downward direction, passengers waiting dock-side could be sprayed with water as the boat comes to rest.

Another feature which enhances the performance of the tunnel 13 is that the rear exit opening 14 is of the same size as or only slightly smaller than the cross-sectional area of the tunnel 13 at the transom 6. A preferred size for the exit 14 provides for a one-quarter inch lip that allows a secure joint to be made with the hull at the transom 6, while allowing for the sudden evacuation of the water ballast when power is applied to achieve planning. In such circumstances, with a wide enough air vent passage 15, on the order of 2 inches in diameter, the water is virtually left behind. The corners of the lip are heavily radiused to transfer loads laterally into the hull and interior floor from the transom 6 during such procedures.

A recess 21 is formed along the outboard side of the side portion of the hull 1 below the gunwale 3 to receive the tube portions 5. Preferably the gunwale 3 with its deck portion 4 substantially overlies no more than 50% of the tube 5. This exposes a considerable portion of the tube 5 to act as a bumper.

The side portion 34 of the hull 1 within the recess 21 may also extend beneath only ⅛th of the circumferential area of the tube 5 in order to provide more expansion space for the tube 5 when it acts as a bumper. Thus, in the preferred form of FIGS. 3 or 6, the tube portion 5 is embraced by the recess 21 over only about 40% of its circumference.

The tube portions 5 are anchored to the hull 1 through coupling rings 22 which act as coupling means 22 adhesively retained bonded to the tube 5, or attached to straps (not shown) embracing the tubes 5. These coupling rings 22 serve as the tube-side attachment means for engaging the tube portions 5.

Figure 5:
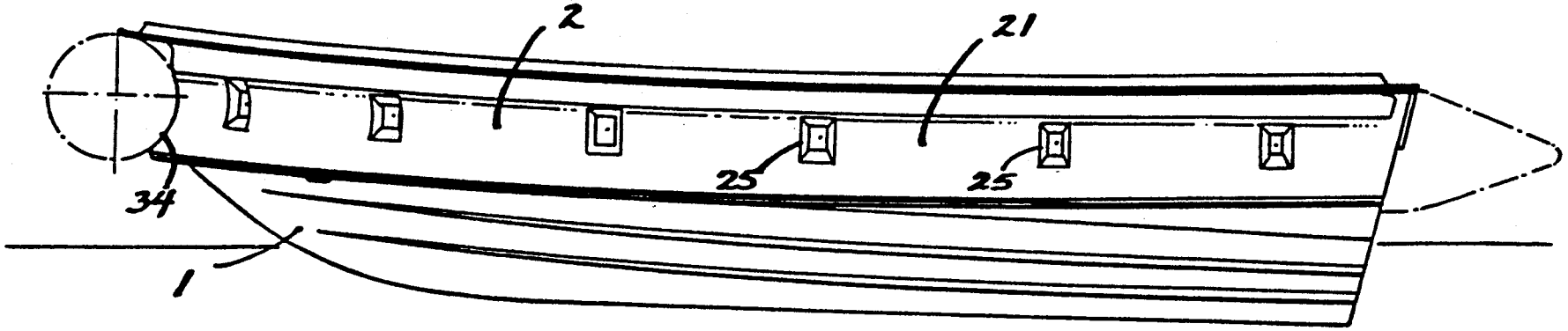
FIG. 5 is a side view of the boat with pneumatic tubes removed.

In FIG. 5 complementary attachment means in the form of an eyelet 23 bolted through the side portion 2 of the hull 1 within the recess 21 is shown coupled to the coupling ring 22. This eyelet 23 constitutes the boat-side fastening hardware that holds the tubes in place. Additional fastening means 40 under the deck portion 4 of the gunwale 3, may serve to hold the tubes 5 in place.

Figure 6:
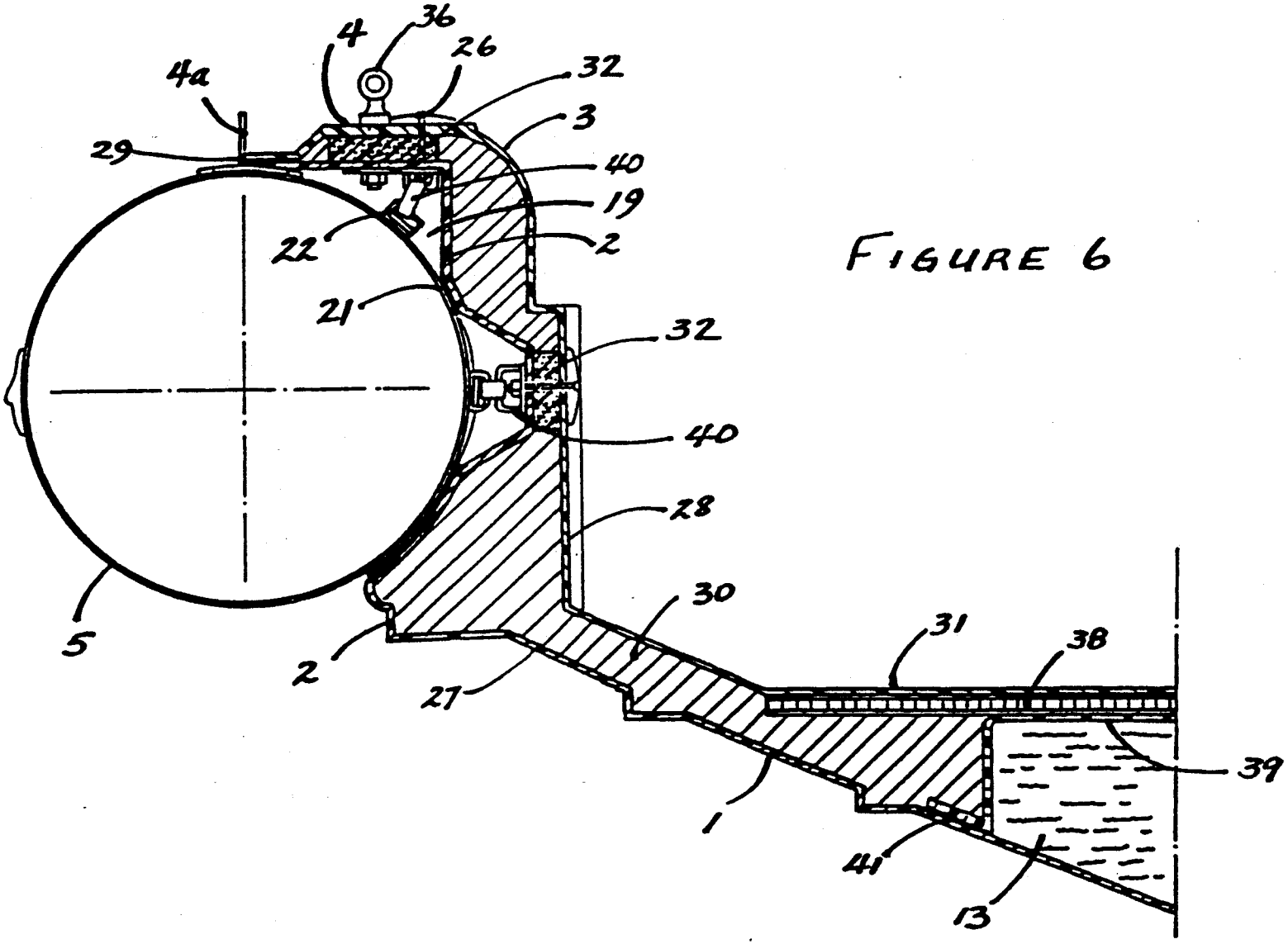
FIG. 6 is a cross-section of the gunwale portion of the hull showing the attachment means for the pneumatic tubes.

The attachment system of FIG. 5 in the preferred embodiment relies on discrete cavities or pockets 25 formed within the hull side 2 intermittently along the outer sides of the hull 1. These pockets 25, shown further in FIG. 6, are all outwardly, horizontally directed, but may also optionally form a continuous cavity along the length of the hull 1. The deck portion 4 of the gunwale 3 may also be penetrated by fastening hardware 26 which serves as attachment means to engage the coupling means 22 mounted on the inboard side of the tube 5 at the location of the under-deck cavity 19.

In FIGS. 5 and 6 the details for the attachment of both accessories anchors 36 and of the pneumatic tube 5 to the hull are shown.

A continuous under-deck cavity 19 is shown as being formed between the tube portions 5, for one part, and the gunwale 3 and side portions 2 of the hull 1 for the other part. This cavity 19, situated directly under the deck 4, is shown as continuous and this is to be preferred. But it may also be intermittent so long as care is taken to attach accessories 36 to the deck portion 4 only where a cavity portion 19 is present.

The object of forming this cavity 19 is twofold. The first is to provide space for the penetration of bolts or eyelets 36 through the deck portion 4 whereby above-deck hardware (not shown) may be fastened to the gunwale 3. The other is to provide space for below deck fastening hardware 40 that functions as attachment means by which the tube portions 5 may be attached to the hull 1.

The hull 1 is preferably made with outer 27 and inner 28 shells bonded together at a bond-line 29 along the gunwale and a wood reinforced bond-line 38 between the floor 31 and the top 39 of the tunnel 15. The tunnel 13 is, in turn, bonded to the hull 1 along its flanges 41. The space 30 there between may be filled with closed-cell polymeric foam to provide floatation. Wood 32 or high density foam may also be inserted within this space 30 where rigidity is especially required, as for example, under the deck portion 4 or inboard of the tube anchoring pockets 25.

Because of the continuity of the outer shell 27 up to the gunwale 3, the boat will remain fully floatable, even without the tubes 5 present, or if such tubes are deflated.

Because of the depth of the keel extending below the hull 1 with a distinct "V" profile, the boat will respond stably at high speeds. Because of the water ballast tunnel, the boat will float with minimum, but positive, free-board—between the water line and the tubes 5 at low speeds.

Conclusion

The foregoing has constituted a description of specific embodiments showing how the invention may be applied and put into use. These embodiments are only exemplary. The invention in its broadest, and more specific aspects, is further described and defined in the claims which now follow.

In describing the preferred embodiments of the subject invention illustrated in the drawings, specific terminology has been resorted to for the sake of clarity. However, the invention is not intended to be limited to the specific terms so selected, and it is to be understood that each specific term includes all technical equivalents which operate in a similar manner to accomplish a similar purpose.

The embodiments of the invention in which an exclusive property or privilege is claimed are defined as follows:

1. A rigid inflatable boat comprising:

(1) a rigid hull with a keel and a side portion that terminates in a rigid gunwale along its upper edge, the boat having a load-supporting deck separate from but attached to the gunwale along the outer periphery of the gunwale with fastening hardware mounted thereon, said fastening hardware passing completely through the deck; and having lower ends extending under the deck;

(2) a pneumatic, tube-receiving longitudinal recess formed in said hull along the out-board side of the hull, beneath the deck portion; and (3) a pneumatic tube anchored within the recess, said hull being provided with a self-evacuating water ballast tunnel along the keel, the displacement of such hull, with the water ballast tunnel flooded and the boat loaded to its standard capacity, being such that the pneumatic tubes ride clear of the water with minimal free-board, preferably of about three inches, there being provided within the longitudinal recess a cavity extending between the inboard side of the pneumatic tube and the outer surface of the hull, such cavity being positioned, and of sufficient dimensions to receive and accommodate the lower ends of said fastening hardware penetrating therein.

2. A rigid inflatable boat as in claim 1 wherein the cavity extends longitudinally to the side of the side portion of the hull providing a continuous under-deck open space into which said fastening hardware may enter.

3. A rigid inflatable boat as in claim 1 wherein the foregoing recess does not embrace substantially more than 50 percent of the circumference of the pneumatic tube.

4. A rigid inflatable boat as in claim 1 wherein the recess does not embrace more than 40% of the circumference of the pneumatic tube, and the deck portion of the gunwale does not over-lie more than 50% of the pneumatic tube.

5. A rigid inflatable boat as in claim 1 wherein the boat has a hull of such dimensions as to be floatational and seaworthy, when fully loaded, even in the absence of inflated pneumatic tubes.

* * * * *